United States Patent [19]

Yoshida et al.

[11] 4,285,798

[45] Aug. 25, 1981

[54] METHOD OF PRODUCING AN ELECTRODE

[75] Inventors: Mitsuo Yoshida; Akira Nakamura; Keiichi Ohmure; Atsuo Ono, all of Nobeoka, Japan

[73] Assignee: Asahi Kasei Kogyo Kabushiki Kaisha, Osaka, Japan

[21] Appl. No.: 96,888

[22] Filed: Nov. 23, 1979

[30] Foreign Application Priority Data

Nov. 24, 1978 [JP] Japan ..... 53-144235

[51] Int. Cl.[3] ..... C25B 11/10; B05D 5/12; C25B 11/06

[52] U.S. Cl. ..... 204/290 F; 427/126.3; 427/126.5

[58] Field of Search ..... 204/290 F; 427/126.1, 427/126.3, 126.5

[56] References Cited

U.S. PATENT DOCUMENTS

| | | | |
|---|---|---|---|
| 3,701,724 | 10/1972 | Entwisle et al. | 204/290 F |
| 3,718,551 | 2/1973 | Martinsons | 204/98 |
| 3,950,240 | 4/1976 | Cookfair et al. | 204/290 F |
| 4,049,532 | 9/1977 | Clerbois et al. | 204/290 F |

FOREIGN PATENT DOCUMENTS 1480807 7/1977 United Kingdom .

*Primary Examiner*—F. Edmondson

*Attorney, Agent, or Firm*—Birch, Stewart, Kolasch & Birch

[57] ABSTRACT

A method of producing an electrode by applying onto a core material a solution of at least one metal salt and subjecting the resultant core material to a heat treatment in a heating zone, characterized in that said heat treatment comprises continuously elevating the temperature of the resultant core material to a temperature of about 400° to 700° C. over a period of about 5 minutes to 2 hours, while blowing air into the heating zone to obtain a coated electrode. The coated electrode produced according to the method of the present invention is excellent in adherence of the coating to the core material and has long life due to low losses of the coating during use.

11 Claims, No Drawings

METHOD OF PRODUCING AN ELECTRODE

BACKGROUND AND SUMMARY OF THE INVENTION

The present invention relates to a method of producing a coated electrode. More particularly, the present invention is concerned with a method of producing an electrode which comprises applying onto the surface of a corrosion-resistant electroconductive core material a solution of at least one metal salt capable of forming an electroconductive substance by heat treatment, and subjecting the electroconductive core material having said at least one metal salt applied thereonto to a heat treatment.

In the production of coated electrodes which are used in reactions using electrodes, there have recently been proposed various methods in which a metal compound such as at least one metal salt, at least one metal oxide and/or its corresponding hydroxide is applied to an electroconductive core material and the resulting electroconductive core material having said metal compound applied thereonto is subjected to a heat treatment. According to these methods, an electroconductive coating, excellent in catalytic properties for electrolytic reactions can be formed and easily adhered to a corrosion-resistant electroconductive core material. These methods have been developed as advantageous methods for the production of a coated electrode of long life which is low in losses of coating during use. However, the electrodes produced according to the conventional methods are still not sufficiently satisfactory in losses of electroconductive coating during use. Therefore, various attempts have been made for making an improved coated electrode which is lower in losses of electroconductive coating. For example, in British Pat. No. 1,480,807, there is proposed a method of making coated electrodes which comprises applying to a core material a solution of at least one metal salt or a dispersion of at least one metal oxide and/or its corresponding hydroxide, followed by a heat treatment which is carried out in three phases, namely, (A) drying at a temperature ranging from 80° to 120° C.;

(B) heating at a temperature ranging from 175° to 300° C.; and (C) heating at a temperature ranging from 400° to 650° C. However, this method is still unsatisfactory because it does not give a coated electrode having sufficient durability.

Intensive studies have been made to understand the relationship between heat treatment conditions and losses of electroconductive coating during use. As a result, it has been found that the losses of electroconductive coating have a close relationship to the feed rate of an oxidizing gas, such as air, and the rate of temperature elevation in the heat treatment of an electroconductive core material having at least one metal salt applied thereonto.

More specifically, in accordance with the present invention, there is provided a method of producing an electrode which comprises applying to the surface of a corrosion-resistant electroconductive core material a solution of at least one metal salt capable of forming an electroconductive substance by heat treatment, and subjecting the resulting core material having said at least one metal salt applied onto the surface thereof to a heat treatment in a heating zone, said heat treatment comprising continuously elevating the temperature of said resulting coated core material to 400° to 700° C. over a period of time of 5 minutes to 2 hours while blowing air into the heating zone. In the electrode prepared according to the method of the present invention, the electroconductive coating is a substance having an excellent adherence to the core material, and the electrode has a long life due to low losses of electroconductive coating during use. The term "continuously elevating the temperature" and "continuous temperature elevation" as used herein is intended to mean elevation of the temperature at a substantially constant rate to a predetermined temperature wherein a corrosion-resistant electroconductive core material having at least one metal salt applied thereonto is heated up without experiencing heating at constant temperature.

Corrosion-resistant electroconductive core materials to be used in the method of the present invention are those materials which are corrosion-resistant to electrolytic solutions and electrolytic reaction products with which the materials will be contacted when they are used as electrodes in electrolysis. As the corrosion-resistant electroconductive core materials, there can be mentioned, for example, titanium, tantalum, zirconium, niobium, iron and alloys composed predominantly of at least one of said metals, and graphite.

Electroconductive substances to be coated on the surfaces of corrosion-resistant electroconductive core materials are those substances which are corrosion-resistant to electrolytic solutions and electrolytic reaction products with which the substances will be contacted when they are used as coatings of electrodes and which have a good catalytic property for electrolytic reactions. As the electroconductive substances, there can be mentioned, for example, oxides respectively containing platinum, rhodium, ruthenium, iridium, palladium, gold and nickel and mixtures thereof, and oxygen-containing solid solutions containing one or more of the above-mentioned metals. Of these electroconductive substances, the oxygen-containing solid solutions provide coated electrodes very excellent durability (with respect to losses of coating during use) and catalytic properties for electrolytic reactions. Where a solution of salts of two or more metals are used for application thereof to a core material, there is a possibility that an oxygen-containing solid solution of said two or more metals is formed by the subsequent heat treatment (see, for example, U.S. Pat. No. 4,005,004). The formation of oxygen-containing solid solution can be proved by X-ray diffraction.

Any salt of the metal may be used for the preparation of a solution of at least one metal salt to be applied onto an electroconductive core material as long as it can form an electroconductive substance by heat treatment. In general, however, metal salts having high solubility in a solvent are preferred, such as metal chlorides, metal nitrates and metal sulfates. In this connection, it is noted that it is possible to employ a metal salt which may not completely be dissolved in the solvent, and hence the solution may assume a somewhat colloidal or suspended state, which is, however, permissible.

As a solvent to be used for the preparation of a solution of at least one metal salt, commonly used solvents are preferred, such as an aqueous solution of hydrogen chloride, aqueous solutions containing an oxidizing substance such as nitric acid or hydrogen peroxide, organic solvents, e.g., ethanol and isopropyl-alcohol, and mixtures thereof. Nitric acid or hydrogen peroxide may promote the oxidation reaction of a metal salt, thereby producing the corresponding metal oxide without occurrence of the hydrolysis of the metal salt, and may serve to avoid conversion of the metallic values of the electroconductive coating to the metallic state. The metal salt concentration of the solution to be applied to the core material varies depending upon the kind of metal salt, the method of application and the like, but may usually be within the range of from about 1 to 50 percent by weight.

The metal salt solution capable of forming an electroconductive substance by heat treatment is applied to a corrosion-resistant electroconductive core material according to a commonly employed method, such as spray-coating, dipping, painting or roller-coating. The metal salt concentration of the solution, the viscosity of the solution, the number of times of unit application of the solution and the like are controlled so as to give a coating thickness as thin as possible per unit application of the solution, for example, as thin as $3\mu$ or less, preferably $0.5\mu$ or less in terms of the thickness of the coating formed by the heat treatment. After each unit application, the corrosion-resistant electroconductive core material having said metal salt applied thereto is subjected to a heat treatment which comprises continuously elevating the temperature of the core material having said metal salt applied thereonto to 400° to 700° C. to evaporate the solvent and oxidize-decompose said metal salt, thereby forming an electroconductive substance and simultaneously causing the electroconductive substance to be firmly adhered to the corrosion-resistant electroconductive core material. In this instance, it is indispensable that the continuous temperature elevation should be effected over a period of time of 5 minutes to 2 hours while blowing air into the heating zone. The time for which a predetermined temperature of the heat treatment within the range of from 400° to 700° C. inclusive (the continuous temperature elevation has been made to said predetermined temperature) is maintained is not critical at all because the time of 5 minutes to 2 hours employed for effecting the continuous temperature elevation may minimize the time for the heat treatment and any further heat treatment at said predetermined temperature for any period of time does not cause any trouble.

One embodiment in which at least one metal chloride is used as said metal salt capable of forming an electroconductive substance by heat treatment and an aqueous solution of hydrogen chloride (hydrochloric acid) is used as a solvent will be explained by way of example for illustrating the features of the present invention. However, this embodiment should not be construed as limiting the scope of the invention.

An aqueous solution of at least one metal chloride in hydrochloric acid is applied onto a corrosion-resistant electroconductive core material, followed by heating to evaporate water, hydrogen chloride and water of hydration. The at least one metal chloride is oxidation-decomposed during the heat treatment comprising the continuous temperature elevation by heating and any further heat treatment at a predetermined temperature to which the temperature is elevated, thereby to form at least one metal oxide corresponding thereto or an oxygen-containing solid solution derived therefrom which is firmly adhered to the corrosion-resistant electroconductive core material. In the method of the present invention, it has been found to be essential to remove as soon as possible from the surface of the coated core material gases such as gaseous water, hydrogen chloride and gaseous decomposition products which are produced in the course of the oxidation-decomposition reaction and to supply fresh air into the heating zone for the metal chloride-applied core material. For achieving this, air is blown into a heating apparatus. By the blowing of air, the air is caused to pass uniformly over the surface of the metal chloride-applied core material, whereby gases such as gaseous water, hydrogen chloride and gaseous decomposition products as mentioned above are rapidly replaced by fresh air. Air may be mixed with oxygen to increase the oxygen concentration. The blowing of air into the heating zone may be conducted continuously or intermittently, or may be conducted with a constant rate or with variation of rate as far as the gases generated can be smoothly replaced by fresh air (illustrative explanation will be given later).

If a large amount of the gases such as gaseous water, hydrogen chloride and gaseous decomposition products are generated at a time, the rapid removal of them from the surface of the metal chloride-applied core material becomes difficult. Accordingly, the continuous temperature elevation to a predetermined temperature is required to be effected slowly and, specifically speaking, to be effected over a period of time of at least 5 minutes, prefereably over a period of time of 20 minutes or more. When the continuous temperature elevation by heating is effected over a period of more than 2 hours, no increase in the effect as achieved in the present invention is observed. Usually, it is sufficient to effect the continuous temperature elevation over a period of up to about 1 hour. The elevation rate of the temperature in the heating zone may be influenced by the rate of air blown into the heating zone.

The blowing rate of air may be not more than 100 $m^3$/hr per 1 $m^2$ of the projective area of the coated core material. The term "projective area" as used herein is intended to mean an area of the profile defined by the periphery of the projective figure which the coated core material gives on a plane disposed in parallel with the substantial plane assumed by the coated core material on the whole when parallel light is cast perpendicularly to said substantial plane of the coated core material. If the blowing rate of air is too large, the time required for effecting the continuous temperature elevation to a predetermined temperature is disadvantageously prolonged. The blowing rate of air may generally be not less than 0.8 $m^3$/hr, preferably not less than 2 $m^3$/hr per 1 $m^2$ of the projective area of the core material, through the lower limit of air-blowing rate is influenced by the internal volume of a heating apparatus. If the blowing rate of air is too small, the effect of blowing air becomes small. Where a relatively large amount of air is blown into a heating apparatus with a small capacity of heat source, the temperature inside the heating apparatus cannot be continuously elevated or adversely reduced and the temperature distribution inside the heating apparatus tends to be very nonuniform, with the result that an electrode having good properties cannot be obtained. For avoiding these unfavorable tendencies, it may be advantageous to blow, preliminarily, heated air into the heating apparatus. In this case, the preliminary heating of air to be blown into the heating apparatus is carried out so as to make up for the insufficiency of the heating capacity of the heating apparatus and may advantageously be carried out in such a manner that the temperature of the preliminarily heated air, to be successively blown into the heating apparatus, is gradually increased in accordance with the elevation of the temperature inside the heating apparatus. It may also be advantageous that the core material having the solution of at least one metal chloride applied thereonto is subjected to preliminary drying at a temperature ranging from room temperature to the boiling point of the solvent to evaporate the solvent, followed by the heat treatment comprising continuously elevating the temperature of the metal chloride-applied core material. In this case, the preliminary drying is believed to be effective due to a reduction in the amount of the solvent, for minimizing the occurrence of hydrolysis of the metal chloride during the subsequent heat treatment.

As described before, the blowing of air into the heating zone may be conducted continuously or intermittently, or may be conducted with a constant rate or with variation of rate. In this connection, it should be noted that the time for which the blowing rate of air is uninterruptedly below 0.8 $m^3$/hr per 1 $m^2$ of the projective area of the coated core material is preferably not more than 2 minutes and the average blowing rate of air in the heat treatment by continuously elevating the temperature of the salt-applied core material is necessarily about 0.8 to 100 $m^3$/per 1 $m^2$ of said projective area.

A coated electrode produced according to the above-mentioned embodiment of the present invention is excellent in adherence of the electroconductive substance coating to the corrosion-resistance electroconductive core material and low in losses of the electroconductive coating during use. The reason why a coated electrode of the character as described above is obtained according to the present invention is not exactly known but is believed to be, as will be explained below, due to the fact that a great difference in composition of gaseous decomposition products is observed between the case where the continuous temperature elevation by heating is effected slowly while blowing air into the heating zone and the case where the temperature elevation by heating is effected rapidly either with or without the blowing of air into the heating zone.

In the case where the continuous temperature elevation by heating is effected slowly while blowing air into the heating zone, more than 30 percent of the chlorine values of at least one metal chloride in the solution is converted into a chlorine gas upon the decomposition of the metal chloride. On the other hand, in the case where the temperature elevation by heating is effected rapidly either with or without the blowing of air into the heating zone, substantially all of the chlorine values of at least one metal chloride in the solution is converted into a hydrogen chloride gas upon decomposition of the metal chloride. From the above-mentioned facts, it is believed that in the method of the present invention a decomposition reaction of said metal chloride is different in mechanism from those involved in the conventional methods and the decomposition reaction involved in the method of the present invention will contribute to the improvements in adherence of the electroconductive substance coating to the core material and in lowering losses of the electroconductive substance coating during use for electrolysis reaction.

Where a hydrogen chloride gas is generated as a decomposition gas, it is believed that said at least one metal chloride is hydrolyzed into hydrogen chloride which is vaporized as the hydrogen chloride gas and the at least one metal hydroxide corresponding thereto, which is then dehydrated to form at least one metal oxide corresponding thereto or an oxygen-containing solid solution derived therefrom. On the other hand, where a chlorine gas is generated as a decomposition gas, it is believed that at least one metal chloride is directly oxidation-decomposed by means of oxygen to form a chlorine gas and at least one metal oxide corresponding thereto or an oxygen-containing solid solution derived therefrom.

It is believed to be essential in order to obtain an electroconductive coating which is excellent in adherence thereof to the core material and low in losses thereof during use, that a signigicant amount of at least one metal chloride be directly oxidation-decomposed, not via the formation of the metal hydroxide corresponding thereto. It is to be noted that this direct oxidation-decomposition is promoted by the slow continuous temperature elevation with substantially continuous blowing of air into the heating zone.

In the above-mentioned embodiment, explanation is made only with respect to the case where a coated electrode is produced by a single operation (application of a solution of at least one metal salt onto an electroconductive core material→specific heat treatment of the metal salt-applied core material while blowing air into the heating zone) of the present invention. However, according to the present invention, the same operation as mentioned above may be repeated, for example, 2 to 30 times to produce a coated electrode. Moreover, according to need, the coated electrode produced by the method of the present invention may further be subjected to a post heat treatment which is carried out, for example, at a temperature of 450° to 600° C. for a period of 10 minutes to 12 hours.

The following examples illustrate the present invention in more detail but should not be construed as limiting the scope of the invention.

In the Examples and Comparative Examples, the symbol A indicates electrodes produced according to the method of the present invention and the symbol B indicates comparative electrodes.

EXAMPLE 1 AND COMPARATIVE EXAMPLE 1

A 10 cm×10 cm mesh having an opening rate of 60 percent which had been made of a 1.5 mm-thick titanium plate was polished with a commercially available cleanser and immersed in a 20 percent by weight aqueous solution of sulfuric acid having a temperature of 85° C. for 4 hours to coarsen the surface of the mesh.

A mixture containing:

120 g of water, 30 of 35 percent (by weight) hydrochloric acid, 11 g of $RuCl_3$, and 10 g of $TiCl_4$ was applied onto the mesh by spraying. While blowing air into an electric furnace at a rate of 100 liters/hr, the mixture-applied mesh was so heated up in the electric furnace that the temperature of the mesh was continuously elevated over a period of 40 minutes to a temperature of 480° C. at which the temperature of the mesh was maintained for 5 minutes, thereby effecting a heat treatment of the mixture-applied mesh. After the heat treatment, the average thickness of the coating layer formed on the surface of the mesh was about 0.2$\mu$. The above-mentioned procedures of application of mixture and heat treatment were repeated 10 times. Thereafter, the mesh thus treated was subjected to a post heat treatment at 530° C. for 1 hour to produce an electrode $A_1$.

For the purpose of comparison, an electrode $B_1$ was produced in substantially the same manner as described above except that air was not positively blown into the electric furnace. For the purpose of further comparison, an electrode $B_2$ was produced in substantially the same manner as described above except that the rapid temperature elevation was effected over a period of 2 minutes and air was not positively blown into the electric furnace.

In the production of each electrode, gases which were generated during the heat treatments were collected and analyzed with respect to chlorine gas. In the production of the electrode $A_1$, the amount of a chlorine gas generated was 34 percent based on the total chlorine values contained in the metal chlorides in the mixture applied onto the mesh. In the production of the electrode $B_1$, chlorine gas was scarcely detected.

Through a small electrolytic cell having a cation exchange membrane as a diaphragm, the above-prepared electrode as an anode, and an iron net electrode as a cathode, an aqueous solution of sodium chloride which was always adjusted to have a sodium chloride concentration of 5 N and a pH value of 3.5 was circulated as an anolyte and an aqeous solution of sodium hydroxide which was always adjusted to have a sodium hydroxide concentration of 5 N was circulated as a catholyte. Electrolysis was conducted in the electrolytic cell at a current density of 300 A/dm$^2$ for 18 hours while maintaining the temperatures of both the electrolytes at 90° C. Electrolyses were conducted using the electrodes $A_1$, $B_1$ and $B_2$, respectively. The loss of the electroconductive substance coating of each of the electrodes $A_1$, $B_1$ and $B_2$ was examined and calculated in terms of weight percentage based on the total amount of the coating. The results were as shown in Table 1.

TABLE 1

| | $A_1$ | $B_1$ | $B_2$ |
|---|---|---|---|
| Blowing rate of air (liter/hr) | 100 | 0 | 0 |
| Period of time for temperature elevation (min) | 40 | 40 | 2 |
| Loss of coating (%) | 4.9 | 6.9 | 8.1 |

EXAMPLE 2 AND COMPARATIVE EXAMPLE 2

A 2 cm×10 cm zirconium plate was degreased with a commercially available cleanser and the surface of the plate was coarsened by using a waterproof sandpaper #240 [JIS (Japanese Industrial Standards)-R 6004].

A mixture containing:

80 g of water, 20 g of 35 percent (by weight) hydrochloric acid, and 7 g of $RuCl_3$ was applied to the plate by brushing. While blowing air into an electric furnace at a rate of 160 liters/hr, the mixture-applied plate was so heated up in the electric furnace that the temperature of the plate was continuously elevated over a period of 20 minutes to a temperature of 500° C. at which the temperature of the plate was maintained for 15 minutes, thereby effecting a heat treatment of the mixture-applied plate. After the heat treatment, the average thickness of the coating layer formed on the surface of the mesh was about 0.2μ. The above-mentioned procedures of application of mixture and heat treatment were repeated 5 times to produce an electrode $A_2$.

For the purpose of comparison, an electrode $B_3$ was produced in substantially the same manner as described above except that air was not positively blown into the electric furnace and the rapid temperature elevation was effected over a period of 2 minutes. For the purpose of further comparison, an electrode $B_4$ was produced in the following manner. A mixture-applied plate as prepared above was dried at 110° C. for 10 minutes and heated up rapidly (only over 1 minute) in an electric furnace, without positively blowing air into the electric furnace, to a temperature of 200° C. at which the temperature of the plate was maintained for 15 minutes. Thereafter, without blowing air into the electric furnace, the plate was heated up rapidly (only over 1 minute) to a temperature of 450° C., where the temperature of the plate was then maintained for 20 minutes while blowing air into the electric furnace at a rate of 160 liters/hr. The above-mentioned procedures of application of mixture, drying and heat treatment were repeated 5 times to produce the electrode $B_4$.

In the production of each electrode, gases which were generated during the heat treatments were collected and analyzed with respect to chlorine gas. In the production of the electrode $A_2$, the amount of a chlorine gas generated was 63 percent based on the total chlorine values contained in the metal chloride in the mixture applied onto the plate. In the production of the electrode $B_3$, chlorine gas was scarcely detected.

The loss, during electrolysis, of the coating of electroconductive substance of each of the electrodes $A_2$, $B_3$ and $B_4$ was examined in substantially the same manner as described in Example 1 and Comparative Example 1. The results were as shown in Table 2.

TABLE 2

| | $A_2$ | $B_3$ | $B_4$ |
|---|---|---|---|
| Blowing rate of air | 160 | 0 | 0(at temperatures of less than 450° C.) 160 (at 450° C.) |
| Period of time for temperature elevation (min) | 20 | 2 | 1 (to 200° C.) 1 (to 450° C.) |
| Loss of coating (%) | 15.6 | 25.2 | 21.2 |

EXAMPLE 3 AND COMPARATIVE EXAMPLE 3

A 10 cm×10 cm mesh having an opening rate of 60 percent which had been made of a 1.5 mm thick titanium plate was polished with a commercially available cleanser to effect degreasing and immersed in a 10 percent by weight aqueous solution of oxalic acid having a temperature of 80° C. for 7 hours to render coarse the surface of the mesh.

The mesh was dipped in a mixture containing:

210 g of water, 75 g of 35% (by weight) hydrochloric acid, 18 g of $RuCl_3$, 10 g of $TiCl_4$, and 1 g of $ZrCl_4$ The dipped mesh was dried at 60° C. While blowing air into an electric furnace at a rate of 200 liters/hr, the dried mesh was so heated up in the electric furnace that the temperature of the mesh was continuously elevated over a period of 1 hour to a temperature of 500° C. at which the temperature of the mesh was maintained for 5 minutes, thereby effecting the heat treatment. After the heat treatment, the average thickness of the coating layer formed on the surface of the mesh was about 0.2μ.

The above-mentioned procedures of dipping, drying and heat treatment were repeated 8 times. Thereafter, the mesh thus treated was subjected to a post heat treatment at 550° C. for 3 hours to produce an electrode $A_3$.

For the purpose of comparison, an electrode $B_5$ was produced in substantially the same manner as described above except that the rapid temperature elevation was effected over a period of 2 minutes. For the purpose of further comparison, an electrode $B_6$ was produced in substantially the same manner as described above except that the rapid temperature elevation was effected over a period of 2 minutes and the air was not positively blown into the electric furnace.

In the production of each electrode, gases which were generated during the heat treatments were collected and analyzed with respect to chlorine gas. In the production of the electrode $A_3$, the amount of a chlorine gas generated was 40 percent based on the total chlorine values contained in the metal chlorides in the mixture applied onto the mesh. In the production of the electrode $B_6$, chlorine gas was scarcely detected.

The loss, during electrolysis, of the electroconductive substance coating of each of the electrodes $A_3$, $B_5$ and $B_6$ was examined in substantially the same manner as described in Example 1 and Comparative Example 1. The results were as shown in Table 3.

TABLE 3

| | $A_3$ | $B_5$ | $B_6$ |
|---|---|---|---|
| Blowing rate of air liter/hr) | 200 | 200 | 0 |
| Period of time for temperature elevation (min) | 60 | 2 | 2 |
| Loss of coating (%) | 3.6 | 5.4 | 6.7 |

EXAMPLE 4 AND COMPARATIVE EXAMPLE 4

A 2 cm×5 cm tantalum plate was degreased with a commercially available cleanser and the surface of the plate was rendered coarse by using the waterproof sandpaper #240 as used in Example 2.

A mixture containing:

52 g of water, 26 g of 35% (by weight) hydrochloric acid, 1 g of $RuCl_3$, and 3.8 g of $IrCl_3$ was applied onto the plate by brushing. While blowing air into an electric furnace at a rate of 25 liters/hr, intermittently for one minute every two minutes, the mixture-applied plate was so heated up in the electric furnace that the temperature of the plate was continuously elevated over a period of 1 hour to a temperature of 450° C. at which the temperature of the plate was maintained for 5 minutes, thereby effecting a heat treatment of the mixture-applied plate. After the heat treatment, the average thickness of the coating layer formed on the surface of the plate was about 0.15μ. The above-mentioned procedures of application of mixture and heat treatment were repeated 5 times. Thereafter, the plate thus treated was subjected to a post heat treatment at 510° C. for 1 hour to produce an electrode $A_4$.

For the purpose of comparison, an electrode $B_7$ was produced in substantially the same manner as described above except that air was not positively blown into the electric furnace and the rapid temperature elevation was effected over a period of 2 minutes.

In the production of each electrode, gases which were generated during the heat treatments were collected and analyzed with respect to chlorine gas. In the production of the electrode $A_4$, the amount of a chlorine gas generated was 55 percent based on the total chlorine values contained in the metal chlorides in the mixture applied onto the plate. In the production of the electrode $B_7$, chlorine gas was scarcely detected.

Through a small electrolytic cell having a cation exchange membrane as a diaphragm, the above-prepared electrode as an anode and a stainless steel net electrode as a cathode, an aqueous solution of sodium sulfate and sulfuric acid which was always adjusted to have a sodium sulfate concentration of 2.3 N and a sulfuric acid concentration of 1.1 N was circulated as an anolyte and an aqueous solution of sodium hydroxide which was always adjusted to have a sodium hydroxide concentration of 2.3 N was circulated as a catholyte. Electrolysis was conducted in the electrolytic cell at a current density of 25 A/dm$^2$ for 200 hours while maintaining the temperatures of both the electrolytes at 50° C. Electrolyses were conducted using the electrodes $A_4$ and $B_7$, respectively. The loss of the electroconductive coating of each of the electrodes $A_4$ and $B_7$ was examined and calculated in terms of weight percentage based on the total amount of the coating. The results were as shown in Table 4.

TABLE 4

| | $A_4$ | $B_7$ |
|---|---|---|
| Blowing rate of air (liter/hr) | 25(intermittently for 1 min. every 2 min.) | 0 |
| period of time for temperature elevation (min) | 60 | 2 |
| Loss of coating (%) | 2.8 | 3.5 |

EXAMPLE 5 AND COMPARATIVE EXAMPLE 5

A 10 cm×10 cm mesh having an opening rate of 60 percent which had been made of a 1.5 cm thick titanium plate was immersed in acetone to effect degreasing and further immersed in a 20 percent by weight aqueous solution of sulfuric acid having a temperature of 80° C. for 5 hours to render coarse the surface of the mesh.

A mixture containing:

90 g of water, 10 g of 35% (by weight) hydrochloric acid, 10 g of $RuCl_3$ and 6 g of $TiCl_4$ was applied onto the mesh by brushing. While blowing preheated air into an electric furnace, the mixture-applied mesh was so heated up in the electric furnace that the temperature of the plate was continuously elevated to 450° C. over a period of 30 minutes. The preheating of air was carried out using a hot-air generator capable of heating air in such a way as to gradually increase the air temperature with the gradual elevation of the temperature inside the electric furnace. The blowing rate of air was 500 liters/hr as calculated at 0° C. under atmospheric pressure. After the heat treatment, the average thickness of the coating layer formed on the surface of the mesh was about 0.45μ. The above-mentioned procedures of application of mixture and heat treatment were repeated 5 times. Thereafter, the mesh thus treated was subjected to a post heat treatment at 500° C. for 6 hours to produce an electrode $A_5$.

For the purpose of comparison, an electrode $B_8$ was produced in substantially the same manner as described above except that air was not positively blown into the electnic furnace.

In the production of each electrode, gases which were generated during the heat treatments were collected and analyzed with respect to chlorine gas. In the production of the electrode $A_5$, the amount of a chlorine gas generated was 39 percent based on the total chlorine values contained in the metal chlorides in the mixture applied onto the mesh. In the production of the electrode $B_8$, chlorine gas was scarcely detected.

The loss, during electrolysis, of the electroconductive substance coating of each of the electrodes $A_5$ and $B_8$ was examined in substantially the same manner as described in Example 1 and Comparative Example 1 except that electrolysis was conducted for 10 hours. The results were as shown in Table 5.

TABLE 5

| | $A_5$ | $B_8$ |
|---|---|---|
| Blowing rate of air (liter/hr) | 500 | 0 |
| Period of time for temperature elevation (min) | 30 | 30 |
| Loss of coating (%) | 5.5 | 9.4 |

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method of producing an electrode which comprises applying to the surface of a corrosion-resistant electroconductive core material a solution of at least one metal salt capable of forming an electroconductive substance by heat treatment, and subjecting the resulting coated core material to a heat treatment in a heating zone, said heat treatment comprising continuously elevating the temperature of said resulting coated core material to about 400° to 700° C. over a period of time of about 5 minutes to 2 hours while blowing air into the heating zone at a rate of at least about 0.8 $m^3$/hr per 1 $m^2$ of the projective area of the core material and rapidly removing gaseous products being produced from the surface of said heat treated coated core material.

2. A method according to claim 1, wherein the air is blown into the heating zone at a rate of about 0.8 to 100 $m^3$/hr per 1 $m^2$ of the projective area of said resulting core material, in terms of an average rate in the heat treatment by the continuous elevation of temperature.

3. A method according to claim 1, wherein the temperature of the coated core material is continuously elevated over a period of about 20 minutes to 1 hour.

4. A method according to claim 1, wherein the solution contains salts of at least two metals and the electroconductive substance formed is an oxygen-containing solid solution of said metals.

5. A method according to claim 1, which further comprises preliminary drying between the application of the solution onto the core material and the continuous elevation of the temperature of the coated core material.

6. A method according to claim 1 further including the step of subjecting the resulting heat treated coated core material to a post heat treatment carried out at a temperature of 450° to 600° C. for a period of 10 minutes to 12 hours.

7. The method according to claim 1 wherein the application of said metal salt solution to the electroconductive core material and subsequent heat treatment operation is carried out at least more than one time.

8. The method according to claim 7 wherein the operation is repeated from 2 to 30 times to produce the desired coated electrode.

9. The method according to claim 1 wherein said metal salt is selected from at least one member of the group consisting of metal chlorides, metal nitrates and metal sulfates.

10. The method according to claim 1 wherein the core material having the solution of the metal salt applied thereto is subjected to a preliminary drying step prior to the stated heat treatment.

11. An electrode produced according to the method of claims 1, 2, 3, 4, 5, 6, 7, 8, 9 or 10.

* * * * *